United States Patent [19]

Stein et al.

[11] 4,221,654

[45] Sep. 9, 1980

[54] HYDROPROCESSING COAL LIQUIDS

[75] Inventors: Thomas R. Stein, Cherry Hill; Roland H. Heck, West Deptford; Albert V. Cabal, Woodbury, all of N.J.

[73] Assignee: Electric Power Research Institute, Palo Alto, Calif.

[21] Appl. No.: 913,477

[22] Filed: Jun. 7, 1978

[30] Foreign Application Priority Data

Jun. 26, 1977 [GB] United Kingdom ..... 31307/77

[51] Int. Cl.[2] ..... C10G 1/04; C10L 1/04

[52] U.S. Cl. ..... 208/15; 208/8 LE

[58] Field of Search ..... 208/14, 8 LE, 15

[56] References Cited

U.S. PATENT DOCUMENTS

| | | | |
|---|---|---|---|
| 3,488,279 | 1/1970 | Schulman | 208/10 |
| 3,726,784 | 4/1973 | Correa et al. | 208/8 LE |
| 4,105,535 | 8/1978 | Peters | 208/8 LE |

*Primary Examiner*—Herbert Levine

*Attorney, Agent, or Firm*—Scully, Scott, Murphy & Presser

[57] ABSTRACT

Compatibility of solvent refined coal and other coal liquids with conventional petroleum fuels is improved by moderate catalytic hydrogenation of the solvent refined coal liquid to a hydrogen to carbon atomic ratio less than that of corresponding petroleum fractions. As degree of hydrogenation of solvent refined coal is increased, compatibility with petroleum fractions of like boiling range increases to a maximum measured by precipitation of sediment from the blend of equal parts of the two fuels. That maximum is achieved at a hydrogen/carbon ratio below that of the corresponding petroleum fractions. As that ratio is increased toward the ratio characteristic of a like petroleum fraction, compatibility is impaired.

2 Claims, No Drawings

HYDROPROCESSING COAL LIQUIDS

FIELD OF THE INVENTION

The invention is concerned with treating solvent refined coal (SRC) to render the same compatible with the conventional liquid fuels derived from petroleum. In normal commercial channels of distribution and use as fuel, liquids resulting from solvent refining of coal will be conveyed by the same pipelines, tank cars, trucks and barges as are petroleum fractions of the same grade and will be stored in the same bulk plants and user tanks. It is theoretically possible, but economically impracticable, to clean all such facilities before each shift from one type of product (SRC or petroleum fraction). Even less attractive is the prospect of providing segregated distribution and storage facilities; in effect duplicating the huge and expensive capital plant to serve the vast demand for liquid fuels, both distillates and residual fuels.

The only practical and economically acceptable system is to use existing distribution and storage facilities for both SRC and petroleum fractions as SRC becomes a source of commercial liquid fuels. In order that both products may move freely in commercial channels responsive to supply and demand, it is necessary that they be mixed on occasion. For example, normal pipeline operation involves introduction of a second product to the line immediately upon completing introduction of the last portion of a previous product. Mixing of the two occurs at the interface between the two products. Tankage at a point of use, e.g. a steam generating boiler, will normally be replenished before the tank is empty. In these and many other circumstances, liquid fuels from different sources will become mixed.

It has been found that mixtures of SRC and petroleum fractions result in sediments resulting from incompatibility of the two fuels. A primary objective of this invention is to so treat SRC as to reduce incompatibility sediments to lower levels.

BACKGROUND OF THE INVENTION

The present emphasis on the conversion of coal to substitute solid and liquid fuels has led to several alternative processes which are now being considered. The end use of the resultant converted coal will primarily determine the degree of conversion that must be accomplished and the quality of the desired product. The optimal use of the coal will depend on the specific application.

Among the many processes presently being considered is the solvent refining of coal (SRC) in which coal is treated at an elevated temperature in the presence of a hydrogen-donor solvent and hydrogen gas in order to remove the mineral matter, lower the sulfur content of the coal, and to convert it into a low melting solid which can be solubilized in simple organic solvents. This SRC can also be upgraded through catalytic hydrogenation to produce a liquid of higher quality. These two processes are of concern to the present invention.

Little is known at present as to the exact mechanisms by which the coal is transformed into soluble form, or of the detailed chemical structure of the soluble product or even the parent coal. It is known that many coals are easily solubilized and for others solubilization is more difficult. Some correlations have been made between the rank of the coal and ease of solubilization and product yield. A somewhat better correlation has been found with the petrography of the coal. Little is known about the relationships to product quality.

The initially dissolved coal (SRC) may have utility as a substitute clean fuel or boiler fuel; however, for substitute fuels of higher quality, specifications on viscosity, melting point, ash, hydrogen, and sulfur contents are much more stringent. Attempts to meet these specifications by operating the SRC process more severely have met with many difficulties such as low liquid yields, high hydrogen consumption, difficulty of separating unreacted residue, and excessive char formation, which often completely plugs process transfer lines and reactors.

Alternative methods of improving specifications through catalytic hydrogenation are also difficult. The problems which arise are threefold: (1) SRC components are susceptible to further condensation and may deposit as coke on catalysts used for their conversion, (2) they can also foul the catalysts by physical blockage as their size approaches the pore size of conventional catalysts and (3) they may contain metal contaminants, and their highly polar nature (particularly nitrogenous and sulfur compounds) can lead to selective chemisorption, and thus poison the catalysts.

The precise chemical nature of the SRC is still unknown; generally its composition is discussed in terms of solubility. Several classifications are commonly used. These include oils which are hexane or pentane soluble, asphaltenes which are benzene soluble, and pyridine soluble-benzene insoluble materials. Of these the asphaltenes and pyridine soluble-benzene insoluble materials are believed to be responsible for high viscosity, solvent incompatability, and processing difficulties. Little is known about the pyridine soluble-benzene insoluble materials. These have been referred to as "pre-asphaltenes" which implies that asphaltenes are derived from them; however, this has yet to be established.

More information is available on the nature of asphaltenes. It is common experience that coal liquids contain large quantities of materials known as asphaltenes. In fact, it has even been suggested that the formation of asphaltenes is a necessary step in the liquefaction of coal.

The term asphaltene is a rather nebulous and all-inclusive classification of organic materials for which a detailed chemical and physical identification is quite difficult, and has not yet been accomplished.

This classification generally refers to high molecular weight compounds, boiling above 650° F., which are soluble in benzene and insoluble in a light paraffinic hydrocarbon (e.g., pentane). Usually no distinction is made regarding polarity, as the term has been used customarily in the characterization of heavy petroleum fractions (resids, etc.) where the amount of highly polar materials is small. However, in coal liquids this may not necessarily be the case due to the high degree of functionality of coal itself. Thus, coal liquids of low molecular weight may still be "asphaltenes." There is considerable variation in the molecular weight of solubilized coals which arises from differences in the parent coals, or different solvent or solvent-reactant systems at the same temperature of reaction. This could well be related to colloidal properties of coal liquids. It is well documented that asphaltenes found in heavy petroleum fractions are colloidal in nature.

Some comments on the chemical nature of coal asphaltenes have recently been made. Asphaltenes from Synthoil Process liquids were separated into a basic fraction (containing oxygen only as ether or ring oxygen and basic nitrogen as in pyridine) and an acidic fraction (containing phenolic OH and nitrogen as in pyrrole). The two fractions were found to have very different properties. The basic fraction could be hydrotreated only with difficulty, while the acid fraction underwent facile hydrotreating. This is consistent with reported data on the influence of nitrogen heterocycles on conventional hydroprocessing.

Based on these results an acid-base pair structure for asphaltenes was proposed and this structure was extrapolated to that of coal itself. This structure is quite different from the more amphoteric nature of coal which has been proposed previously.

Mechanisms have been proposed for the noncatalyzed formation of asphaltenes from coal. In this work it was concluded that asphaltenes were a *necessary* product of coal liquefaction and that oils were derived from asphaltenes. The more polar pyridine soluble materials were not investigated and were assumed to be equivalent to unreacted coal. The maximum yield of asphaltenes was found, however, to be a function of the conditions of coal conversion; hydrogen donor solvents greatly reduced the propensity for formation of asphaltenes at low conversion. In addition, it was not determined whether the asphaltene fractions resulting from different conditions were of the same chemical and/or physical nature. Thus, asphaltenes may be inherent constituents of coal products or they could well be the result of either thermal or catalytic transformations of more polar materials.

In considering what may be involved in the formation of asphaltenes during coal solubilization or conversion, it may be instructive to consider what is known of coal structure. Coal is a rather complicated network of polymeric organic species the bulk of which is porous in the natural form; the pore system varies from coal to coal. Depending upon the specific nature of the porous structure of each coal, its chemical constituents, and the reaction conditions, the rate of diffusion and mass transport of organic molecules through the pores could have a strong effect on the rates of dissolution, hydrogen transfer, and hydrogenation and hydrocracking reactions, and thus on the ultimate yield of soluble product.

As the rank of coal becomes higher, an increasing number of colloidal size aggregates (20–50 Å) can be observed by X-ray scattering and diffraction.

If, in the early stages of the dissolution of coal these coiloidal aggregates dissociate to some degree and go into solution, the molecular weight of the lowest unit appears to be consistent with the lowest molecular weights observed in solubilized coals (~500 MW). This comparison may be coincidental, however. Unfortunately, in order to dissolve coal it is generally found that temperatures in excess of 300° C. are necessary. It is also known that coal begins to pyrolize and evolve volatile matter at temperatures as low as 250° C. (depending on rank), and by 350° C. considerable material has evolved. This strongly suggests that extensive internal rearrangement of the coal occurs during the dissolution process. Rearrangement can include hydrogen migration to produce highly condensed aromatic rings as well as further association of small colloidal aggregates or condensation of reactive species. Major physical changes in the pore system of the solid coal have also been reported.

This rearrangement could possibly be responsible for some of the very high molecular weights (~3000 MW) observed with some solvents. No detailed relationships of solvent type and/or reaction condition to the molecular weight distribution of solubilized coal has yet been established. Similarly, the possibility of reversible molecular weight changes, due to recondensation causing increased molecular weights at various temperatures, has not been investigated thoroughly.

An alternative route to high molecular weight is through the catalytic influence of inorganic coal minerals which are present in the processing of coal. It is known that some coals are more reactive than others, producing higher yields of liquid products at shorter residence times. It is believed that this is due to the fact that the initial coal products are reactive and condense to char unless proper reaction conditions are established. This further condensation could well be a catalytic phenomenon induced by intrinsic coal minerals.

Another more subtle consequence of certain inorganic constituents is their influence on the physical properties of pyrolytic coal chars, and thus on the diffusional properties imposed on reactive intermediates. The volume of char has been observed to vary by a factor of four or more, with little change in weight, by varying the type of inorganic contaminants in a given bituminous coking coal. The pore system of the resultant chars must be vastly different and changes of this type magnitude in the physical structure of the coal or char could greatly influence mass transport of intermediates produced within the pore system. Mass transfer limitation during the pyrolysis and hydrogasification of some coals at high temperatures has recently been established. This study showed that for some coals, reactive primary products are formed which can recombine to produce char if the conditions are not properly adjusted. The criticality was found to be the rate of diffusion of the reactive species out of the coal relative to its rate of conversion to char.

At lower temperatures, the rates of reaction are, of course, slower and thus less susceptible to mass transport limitations. However, the imposition of a liquid phase, commonly used in liquefaction processes, may greatly enhance diffusional retrictions. Recent model studies conducted in aqueous systems, have shown that restriction of diffusion through porous structures with pore radii ranging from 45 Å to 300 Å for even relatively small solute molecules is very significant.

At the present stage of the art, the accumulated information is largely empirical, with little basis for sound extrapolation to predict detailed nature of solvent and processing conditions for optimum yield and quality of solvent refined coal. It is recognized that the poorly understood asphaltenes are probable sources of many of the problems encountered, e.g. formation of char at processing conditions conducive to efficient separation of mineral matter (ash) and sulfur from desired product at high yield.

In the process of converting coal to a low sulfur, low melting solid by use of recycled product fractions as solvent, several reaction steps occur. Generally coal is admixed with a suitable solvent recycle stream and hydrogen and the slurry is passed through a preheater to raise the reactants to a desired reaction temperature. For bituminous coal, the coal is substantially dissolved by the time it exits the preheater. Sub-bituminous coals can be dissolved but care must be exercised not to raise the temperature too high and thus promote charring.

The products exiting from the preheater are then transferred to a larger backmixed reactor where further conversion takes place to lower the heteroatom content of the dissolved coal to specification sulfur content and melting point. The geometry of this reactor is such that the linear flow rate through it is not sufficient to discharge a substantial quantity of particulate matter of a desired size. Thus the reactor volume becomes filled (at steady state) up to about 40 vol % by solids which are produced from the coal. These solids have been shown to be catalytic for the removal of heteroatoms and the introduction of hydrogen into the coal products and solvent. The products exiting the reactor are initially separated by flash distillation, which depressurizes the stream and removes gases and light organic liquids. The products are further separated (filtration, centrifugation, solvent precipitation, etc.) and the filtrate is distilled to recover solvent range material (for recycle) and the final product SRC.

The solvent refined coal recovered from such processing is a solid at ambient temperature and is constituted by material boiling above about 650° F. Recycle solvent boiling in the range of 260°-650° F. is the balance of the reactor effluent after removal of gases and light organic liquid boiling below about 260° F. The recycle solvent fraction is produced in amounts of about 10-15% by weight based on the coal charged to the solvent process. This material differs in nature of components from petroleum fractions but is generally miscible with petroleum cuts. The solid SRC is produced in yields between about 50 and 65 weight percent based on charge and exhibits great differences in composition from the conventional petroleum fuels. It is, of course, miscible with recycle solvent, but is highly incompatible with petroleum fractions of like boiling range.

Whatever the chemical nature and reactivity of the large number of chemical species in SRC and in recycle solvent and whatever physical form they may take, the aggregate liquid fuel is of a different nature than the well-known petroleum fractions which have long served to satisfy the demand for liquid fuels, both distillates and resids, typified by No. 2 and No. 6 fuel oils, respectively. For example, the so-called "asphaltenes", generally defined as the compounds soluble in benzene and insoluble in paraffins are of relatively low molecular weight in SRC ranging from below 1000 up to about 1300. The asphaltene content of petroleum fractions is constituted by compounds of several thousand molecular weight, on the order of 10,000.

In comparison with petroleum fuels and residua, coal liquids generally exhibit slightly higher carbon content, but significantly lower hydrogen content. These data suggest both a higher degree of aromaticity and a more highly condensed ring structure for coal liquids.

A more striking difference between the coal liquids and petroleum fuels is the heteroatom content. Nitrogen and oxygen in coal liquids are much higher than in petroleum, but sulfur is somewhat lower. Furthermore, 40-70 wt. % of the nitrogen in coal liquids is basic in character compared to 25-30 wt % for typical petroleum stocks.

The differences are strikingly illustrated by the data given by Callen, Simpson, Bendoraitis and Voltz, "Upgrading Coal Liquids to Gas Turbine Fuels. 1. Analytical Charactization of Coal Liquids", I&EC Product Research and Development, 16, 222 (1976). Those authors examined coal liquids by Gradient Elution Chromatography (GEC) and showed the striking differences in relative quantities of GEC fractions from petroleum fractions as compared with coal liquids, reflecting major differences in polarity and other aspects of the molecules constituting these fractions. The Callen et al. article is hereby incorporated by reference, as are:

Cabal et al. "Upgrading Coal Liquids to Gas Turbine Fuels. 2. Compatibility of Coal Liquids with Petroleum Fuels" I&EC Product Research and Development, 16, 58-61 (March, 1977)

Stein et al. "Upgrading Coal Liquids to Gas Turbine Fuels. 3. Exploratory Process Studies", 16, 61-68 (March 1977)

It is to be expected that coal liquids may be upgraded by techniques in advanced stages of development for hydrotreating petroleum fractions to remove sulfur, nitrogen, oxygen and metals. It is further to be expected that, as hydrotreating of coal liquids is carried forward to the point of approaching petroleum fractions in chemical composition by removal of sulfur, nitrogen and oxygen and by increasing the hydrogen/carbon ratio, the treated coal liquid will become more like petroleum and hence more compatible therewith.

SUMMARY OF THE INVENTION

As expected, catalytic hydrotreating of coal liquids such as SRC reduces sulfur, nitrogen, oxygen and metal content. Contrary to expectation, the compatibility of coal liquids with petroleum fuel fractions does not continuously increase as the severity of hydrogenation increases. Compatibility measured as proportion of the blend converted (as by precipitation) to sediment improves from mild to moderate severity to reach a maximum at hydrogen content in weight percent below about 10 of the hydrotreated coal liquid, well below the level of approximately 12 found in most petroleum fuels. The sediment from blends with petroleum fuels increases sharply about 10 weight percent hydrogen for the coal liquid.

In its preferred aspects, the invention contemplates coal liquids from solvent refining of coal constituted by hydrotreated blends of SRC and recycle solvent. The coal liquids are hydrotreated to a severity measured by hydrogen content of the hydrotreated coal liquid between about 7.5 and about 10, preferably 8.5 to 9.5. The amount of hydrogen consumed in hydrotreating may be used in monitoring treatment of any particular coal liquid since a monotonic relationship is found to exist between total hydrogen consumption and hydrogen content of the product, that is the slope of a plot of hydrogen consumption against hydrogen content of the product is essentially constant, but the plots for different charge stocks have different intercepts with the axes.

DESCRIPTION OF SPECIFIC EMBODIMENTS

The nature of the mechanism by which sediments are formed upon mixing coal liquids with petroleum fuels is not susceptible of ready explanation. Coal liquids are known to contain compounds which are insoluble in the less aromatic petroleum fractions. If the incompatibility sediment were an amount roughly equivalent to the content of compounds so insoluble, the effect could be regarded as analagous to propane deasphalting of residual petroleum fractions. That such explanation is inapplicable will be apparent from examples below. Data are shown for blending equal quantities of No. 2 fuel oil and a 2/1 mix of recycle solvent and SRC. The blend contains 50% No. 2 fuel, 33.3% recycle solvent and 16.7% SRC. The incompatibility sediment is greater than the total of SRC in the blend. Knowing that recycle solvent is compatible with No. 2 fuel, it is recognized that the incompatibility sediment must contain some portion of the mutually compatible recycle solvent and fuel oil. See Table 2.

The charge stock for treating in accordance with the present invention may be any of the synthetic fuels derived from coal, all of which exhibit incompatibility with petroleum fuel fractions. This group includes the products of the processes identified as Synthoil and H-Coal as well as the SRC exemplified hereinafter.

The conditions of treatment are generally similar to those utilized in hydrotreating petroleum fuels, distillates and residuals, for desulfurization and denitrogeneration. The catalysts may be any of the commercially available hydrotreating catalysts which are generally cobalt/molybdenum or nickel/molybdenum on a porous base of alumina which may contain up to about 5% silica. The catalyst will have pores within a range characteristic of the particular catalyst. Pore diameter can be a parameter of significance as shown in copending application Ser. No. 913,478 filed June 7, 1978. As there demonstrated, coal liquids having a high proportion of polar asphaltenes can produce solids which clog the reactor if processed over small pore (average 50 Å diameter) catalysts. For stocks of that type, it is preferred to use catalysts in which at least 50% of the pore volume is supplied by pores having a diameter of at least 100 Å.

The parameters of processing severity in hydroprocessing are well understood from developments in hydrotreating petroleum fractions and their interdependence is well recognized. Esentially, the severity is a function of temperature, pressure, hydrogen to hydrocarbon ratio (H/HC) usually stated in standard cubic feet of hydrogen per barrel of feed (SCF/B) or in moles and hourly space velocity in units of charge per unit of catalyst per hour; by weight (WHSV) or volume (LHSV). Severity may be increased by increased temperature, pressure or H/HC or by decreased space velocity (increased catalyst/oil ratio). The variables are interdependent within limits. For example, constant severity at reduced temperatures may be attained by decrease of space velocity. For purposes of the present invention, temperatures will range from about 650° F. to 850° F. at pressures upwards of about 500 psig and space velocities of 0.25 to 2 LHSV. Hydrogen is supplied at a rate of several thousand SCF/B.

The severity of hydroprocessing is conveniently monitored in terms of hydrogen reacted with the charge stock coal liquids. For any given charge, this value can be measured as chemical consumption of hydrogen. The proportion of hydrogen reacted with oxygen, sulfur and nitrogen to yield water, hydrogen sulfide and ammonia remains substantially constant as severity is varied, but that proportion varies from one coal liquid to another. It is therefore preferred to monitor severity as hydrogen content of liquid product from hydrotreating.

It has been found that hydroprocessing of coal liquids improves compatibility with petroleum fuel as severity of treatment is increased to 7.5 weight per cent hydrogen in the liquid product and above, up to about 10 wt % H. Above 10% H, compatibility is impaired by increased severity. Preferably the hydroprocessing is at a severity corresponding to 8.5–9.5% H in the liquid product.

Table 1 lists the properties of a coal liquid consisting of a 2/1 mixture of process solvent/solvent refined coal (SRC) obtained from the Wilsonville SRC pilot plant. The feed coal to the plant was an Illinois No. 6 Monterey coal. The coal liquid is low in hydrogen (6.93 wt %) and high in sulfur (0.57 wt %), nitrogen (1.00 wt %) and oxygen (4.10 wt %). In terms of boiling range and viscosity, it is comparable to a petroleum No. 6 fuel oil.

This material was hydroprocessed over a fixed bed of CoMo on alumina, average pore diameter 71 Å (American Cyanamid HDS-1441A) hydrotreating catalyst. The processing conditions, product yields, and liquid product properties at three conditions (identified as Examples 1, 2 and 3) are also shown in Table 1. The three severity levels correspond to hydrogen consumptions of 1085, 1946 and 2730 SCF $H_2$/Bbl. resulting in liquid products with hydrogen contents of 8.00, 8.93 and 9.84 wt % respectively.

The coal liquid charge and each of the hydroprocessed liquids at conditions corresponding to Table 1 were tested for compatibility with petroleum-derived No. 2 and No. 6 fuels. The results are given in Table 2. In each case the coal liquid was mixed with either a No. 2 or No. 6 petroleum fuel, agitated for 6 hours at 150° F. and centrifuged for 3 hours at 150° F. to determine the sediment in the blends. The raw charge and the mildly hydroprocessed sample (Example 1, 1085 SCF $H_2$/Bbl consumption) gave about 25–30 vol. % sediment with both a No. 2 and a No. 6 fuel. The intermediately hydroprocessed sample (Example 2, 1946 SCF $H_2$ Bbl consumption) gave the lowest sediment value; 10 vol. % with the No. 2 fuel and 8 vol. % with the No. 6 fuel. However, increasing the hydroprocessing severity to a hydrogen consumption of 2730 SCF $H_2$/Bbl in Example 3 resulted in greater incompatibility sediments—15 vol. % with the No. 2 fuel and 13 vol. % with the No. 6 fuel.

Table 1

Hydroprocessing Conditions, Yields, and Liquid Product Properties For Upgrading A 2/1 Blend of Recycle Solvent/Solvent Refined Coal (SRC) Derived From Monterey Coal

| | CHARGE | EX. 1 | EX. 2 | EX. 3 |
|---|---|---|---|---|
| Days on Stream | — | 2,2 | 5,6 | 9,9 |
| Operating Conditions | | | | |
| Temp., °F. | — | 672 | 775 | 777 |
| Pressure, psig | — | 2000 | 2000 | 2000 |
| LHSV | — | .57 | .48 | .25 |
| Liquid Product Properties | | | | |
| API Gravity | −2.7 | 4.0 | 13.5 | 16.7 |
| Hydrogen, Wt. % | 6.93 | 8.00 | 8.93 | 9.84 |
| Sulfur, Wt. % | .57 | .20 | .04 | .07 |
| Nitrogen, Wt. % | 1.00 | .81 | .38 | .25 |
| Oxygen, Wt. % | 4.10 | 2.20 | .60 | .90 |
| CCR, Wt. % | 18.93 | 8.01 | 6.40 | 4.13 |
| Water Wt. % | .00 | 1.36 | .28 | .38 |
| Yields, Wt. % | | | | |
| C1–C3 | — | .14 | 1.51 | 2.46 |
| C4 | — | .95 | .43 | 1.10 |
| C5 | — | 1.23 | 1.46 | .61 |
| C6+ | — | 96.29 | 93.96 | 94.48 |
| $H_2S$ | — | .40 | .56 | .54 |
| $NH_3$ | — | .27 | .78 | .93 |
| $H_2O$ | — | 2.24 | 3.98 | 3.66 |
| $H_2$ Consumption, SCF/Bbl | — | 1085 | 1946 | 2730 |
| Distillation (D-2887), °F. | | | | |
| IBP | 302 | 208 | 172 | 172 |
| 5% | 405 | 363 | 260 | 256 |
| 10 | 417 | 393 | 340 | 320 |
| 30 | 550 | 468 | 427 | 420 |
| 50 | 756 | 558 | 498 | 498 |

Table 1-continued

Hydroprocessing Conditions, Yields, and Liquid Product Properties For Upgrading A 2/1 Blend of Recycle Solvent/Solvent Refined Coal (SRC) Derived From Monterey Coal

| | CHARGE | EX. 1 | EX. 2 | EX. 3 |
|---|---|---|---|---|
| 40 | — | — | 604 | 661 |
| 90 | — | — | — | — |
| 95 | — | — | — | — |
| EP | — | — | — | — |

Table 2

Compatibility of Raw and Hydroprocessed 2/1 Blends of Recycle Solvent/SRC From Monterey Coal With Petroleum Fuel

| Petroleum Stock | Incompatibility Sediment[1], Vol. % | |
|---|---|---|
| | No. 2 Diesel | El Palito No. 6 |
| Raw 2/1 Rec. Solvent/SRC (76D-1669) | 25–30[2] | 25–30[2] |
| HDT 2/1 Blend (Ex. 1) | 25–30[2] | 25–30[2] |
| HDT 2/1 Blend (Ex. 2) | 10 | 8 |
| HDT 2/1 Blend (Ex. 3) | 15 | 13 |

[1]A 50/50 wt. ratio of coal liquid/petroleum stock agitated for six hours at 150° F. followed by centrifuging for three hours at 150° F.

[2]Approximate sediment in jar after heating to 150° F. and mixing. Sample was not centrifuged.

Table 3 is a report of Examples 4–7 on hydroprocessing SRC from Wyodak Coal admixed with recycle solvent in the ratio of 2 weights of recycle solvent per weight of SRC. The catalyst used was the same as that in Examples 1–3. Weight per cent hydrogen in the resultant coal liquids and compatibility with petroleum fuels are shown in Table 4.

TABLE 3

Fixed Bed Hydroprocessing of Coal Liquids
Charge: 2/1 Blend Solvent/SRC Wyodak Coal
Catalyst: HDS-1441A (J-7278)

| | CHARGE | EX. 4 | EX. 5 | EX. 6 | EX. 7 |
|---|---|---|---|---|---|
| Material Balance Wt. % | | 106.3 | 100.3 | 95.3 | 105.6 |
| OPERATING CONDITIONS | | | | | |
| Temperature, °F. | — | 731 | 784 | 772 | 724 |
| Pressure, Psig | — | 2000 | 2000 | 2000 | 2000 |
| LHSV | — | .98 | .97 | .45 | .18 |
| H2 Circulation, SCF/BBL | — | 5423 | 6311 | 6552 | 8041 |
| Days on Stream | — | 2.6 | 3.6 | 4.8 | 10.4 |

TABLE 3-continued

Fixed Bed Hydroprocessing of Coal Liquids
Charge: 2/1 Blend Solvent/SRC Wyodak Coal
Catalyst: HDS-1441A (J-7278)

| | CHARGE | EX. 4 | EX. 5 | EX. 6 | EX. 7 |
|---|---|---|---|---|---|
| YIELDS, WT. % | | | | | |
| C1–C3 | — | .40 | .90 | 1.15 | .67 |
| C4 | — | .24 | .98 | .38 | 1.10 |
| C5 | — | .11 | .76 | .12 | .90 |
| C6+ | 100.00 | 97.72 | 95.62 | 97.31 | 96.53 |
| H2S | — | .27 | .30 | .29 | .30 |
| NH3 | — | .42 | .72 | .83 | .89 |
| H2O | — | 2.41 | 3.53 | 3.73 | 3.85 |
| DISTILLATION °F. (D-2887) | | | | | |
| IBP | 334 | 240 | 198 | 245 | 184 |
| 5% | 387 | 358 | 289 | 328 | 262 |
| 10 | 403 | 402 | 359 | 381 | 335 |
| 30 | 473 | 469 | 447 | 454 | 445 |
| 50 | 569 | 560 | 537 | 537 | 526 |
| 70 | 801 | 686 | 642 | 644 | 671 |
| 90 | — | — | — | — | — |
| 95 | — | — | — | — | — |
| FP | — | — | — | — | — |

Table 4

Compatibility of Raw and Hydroprocessed 2/1 Blends of Recycle Solvent/SRC from Wyodak Coal with Petroleum Fuel

| Petroleum Stock | Wt. % H in Coal Liquids | Incompatibility Sediment[1], Vol. % | |
|---|---|---|---|
| | | No. 2 Diesel | El Palito No. 6 |
| Raw 2/1 Recycle Solv./SRC | 6.5 | 12 | 14 |
| HDT 2/1 Blend (Ex. 4) | 7.7 | 5 | 2 |
| HDT 2/1 Blend (Ex. 5) | 8.6 | 3 | 0.3 |
| HDT 2/1 Blend (Ex. 6) | 9.7 | 0.3 | 1.0 |
| HDT 2/1 Blend (Ex. 7) | 10.0 | 13 | 11 |

[1]A 50/50 wt ratio of coal liquid/petroleum stock was agitated for six hours at 150° F. followed by centrifuging for three hours at 150° F.

We claim:

1. A liquid fuel comprising a mixture of a petroleum fraction and a liquid derived from coal which is a blend of solvent refined coal boiling above about 650° F. and recycle solvent, the said blend having been reacted with hydrogen in the presence of hydrotreating catalyst at a severity to provide hydroprocessed blend of recycle solvent and solvent refined coal having a hydrogen content of 7.5 to 10 weight percent hydrogen.

2. A fuel according to claim 1 wherein said hydroprocessed solvent refined coal has a hydrogen content of 8.5 to 9.5 weight percent.

* * * * *